United States Patent [19]

van Heijst

[11] 4,254,522

[45] Mar. 10, 1981

[54] SINGLE-POINT MOORING BUOY

[75] Inventor: Willem J. van Heijst, Monaco, Monaco

[73] Assignee: Bluewater Terminal Systems N.V., Curacao, Netherlands Antilles

[21] Appl. No.: 7,598

[22] Filed: Jan. 29, 1979

[30] Foreign Application Priority Data

Jan. 30, 1978 [NL] Netherlands ..... 7801062

[51] Int. Cl.[3] ..... B63B 21/52

[52] U.S. Cl. ..... 9/8 P; 114/230

[58] Field of Search ..... 9/8 R, 8 P; 114/230, 114/293; 405/202, 203; 137/236 OS

[56] References Cited

U.S. PATENT DOCUMENTS

| | | | |
|---|---|---|---|
| 3,256,537 | 6/1966 | Clark | 9/8 R |
| 3,668,725 | 6/1972 | Renz et al. | 9/8 R |

FOREIGN PATENT DOCUMENTS

| | | | |
|---|---|---|---|
| 2624703 | 12/1977 | Fed. Rep. of Germany | 114/293 |
| 2029884 | 10/1970 | France | 114/230 |
| 2607 | 12/1918 | Netherlands | 9/8 P |
| 7506107 | 4/1975 | Netherlands | 114/230 |
| 7502829 | 10/1975 | Netherlands | 114/230 |
| 1269496 | 4/1972 | United Kingdom | 9/8 R |

*Primary Examiner*—Sherman D. Basinger

*Attorney, Agent, or Firm*—Arnold, White & Durkee

[57] ABSTRACT

A single-point mooring buoy comprising a buoyance member which is fashioned as an open basket having at its circumference equidistant, substantially vertical columns with buoyancy capacity, said columns being united at their upper side by a spider, in the center of which is mounted a swivel coupling, the stationary part of which is connected through an upper hinge to an upper end of a rigid vertical post or rod carrying the whole assembly is disclosed. The upper hinge is just above the waterline to enhance the stability and the maneuverability of the buoy and to facilitate ease of maintenance, inspection and dismanteling of the buoy. There is further disclosed a second hinge connecting a lower end of the post to a sea anchorage. A riser is preferably mounted on the stationary post and is in fluid communication with a pipeline extending from the rotary buoy, which will follow any rotational movement of a ship being moored to the buoy.

5 Claims, 3 Drawing Figures

SINGLE-POINT MOORING BUOY

Figure 1:
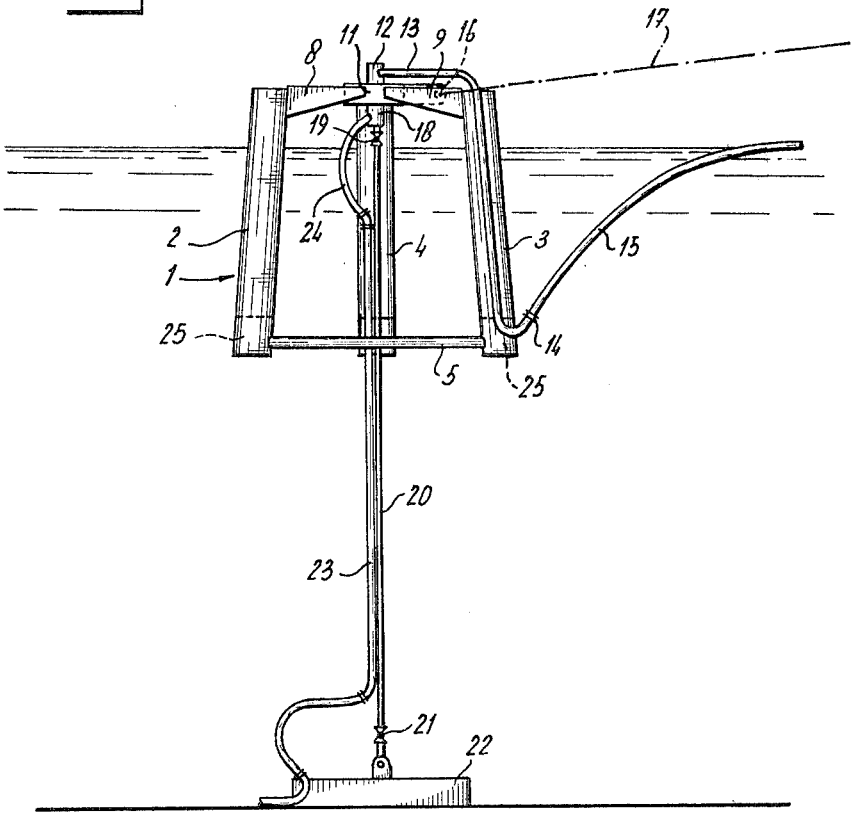

The invention relates to a single-point mooring buoy comprising a ground anchor and hingedly connected thereto a high strength connecting means, such as a chain or a post and a buoy hingedly connected to the upper part of the connecting means, the buoy having its buoyancy mainly below the water level and intersecting the water level with a portion having a small cross section.

A similar single-point mooring buoy is known for instance from the published Dutch Patent Application 75.15095.

In this known buoy the hinge joint is located below the water level between the riser extending along or through the connecting means and the buoy. Consequently these joints are hardly accessible for maintenance and repair purposes.

The behaviour of the buoy in restless water is determined by the mass and the dimensions of the connecting means and the mass and the dimensions of the buoy. In case of the buoy from the herefore said Dutch Patent Application 75.15095 a most favorable own frequency of the buoy and the connecting means are determined by a pre-determined choice of the length and the mass distribution of the buoy body and the connecting means so that these parts may not reach the resonance state when influenced by the occurring wave frequencies.

In shallow water the very place in which the rolling motions of the buoy may be of a rather large amplitude there are less possibilities to keep the own frequency period of the whole sufficiently different from the occurring wave frequencies due to the restricted length of the connecting means.

An object of the invention is to provide a single-point mooring buoy which possesses better rolling properties also but not exclusively in shallow water and which has a better accessibility for maintenance and repair purposes.

In accordance with the invention this object is achieved by the fact that the hinge joint between the upper part of the connecting means and the buoy is above the water level and the buoy consists of members mounted in a regularly distributed manner around the connecting means and linked to each other.

The much higher position of the hinge between the buoy and the connecting means increases the length of the connecting means whereas the position above the water surface facilitate repair and maintenance. Mounting the buoy body around this connecting means and constructing the same with three columns, for instance, there is much more freeness in determining the mass and the dimensions of the buoy body per se, whereas the stability of the buoy may moreover be increased by having the members with buoyancy of the buoy, such as columns, as far apart as possible, and ballasting the lower portion, if desired.

Normally the hawser from the ship to the buoy will strive to displace and to tilt the buoy under influence of the forces acting on the hawser. By having the extension of the hawser in the working point of the buoy running above the hinge one may admit a tilt of the buoy body to an angular position being of the same order of magnitude as the angular deviation of the connecting means from the vertical plane whereby a contact between the connecting means and the buoy body may be prevented.

Warranted by the stable floating characteristics of the buoy body this buoy may be provided with a pipe connection at the lower part thereof for a flexible tube running to the ship, this connection by means of a pipe incorporated in the buoy being connected to a rotatable coupling above the hinge of the buoy and the connecting means. The tube is thereby better protected against the effects of the waves.

Figure 2:
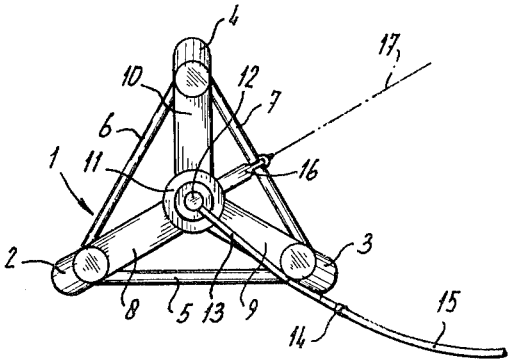

The invention will now be described in detail with reference to the accompagnying drawing, in which FIG. 1 represents a side view elevation of an embodiment of the buoy according to the invention, FIG. 2 represents a plan view of the same.

Figure 3:
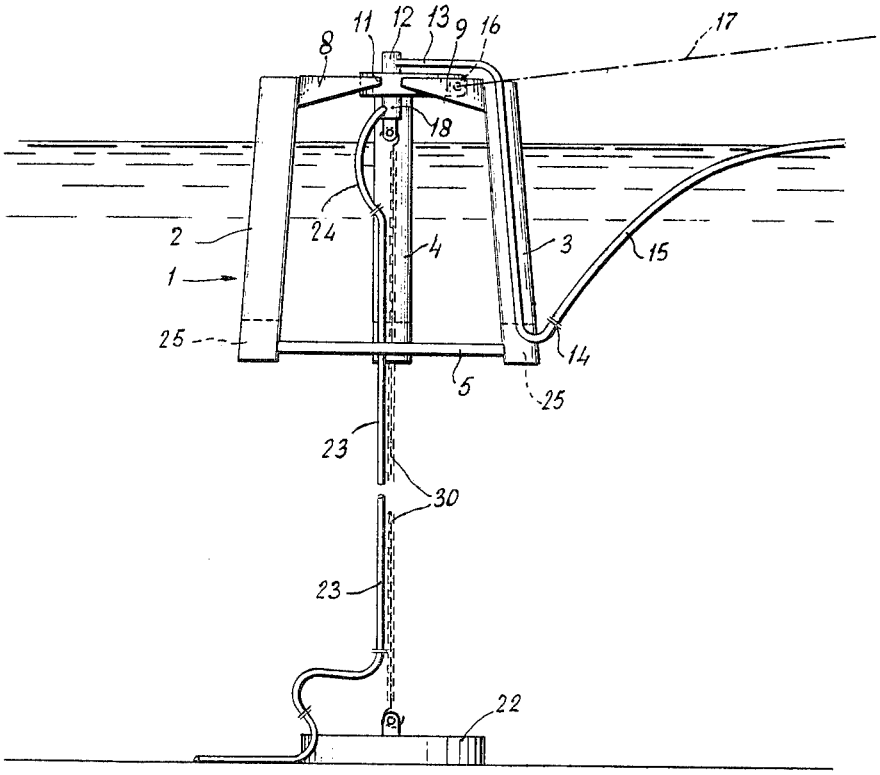

FIG. 3 represents a side view of an alternative embodiment of the buoy according to the invention.

As shown in FIGS. 1 and 2 of the drawings the buoy 1 consists of three buoyant columns 2, 3 and 4 which at the lower parts thereof have been linked to each other by means of pipes 5, 6 and 7 and which at the upper part have been connected with each other by means of arms 8, 9 and 10 and a ring 11 within which a rotatable coupling 12 has been provided from which a pipe 13 runs along the column 3 to a connecting flange 14 to which the flexible tube 15 has been connected. At 16 the mooring point for the hawser 17 is located.

The lower part 18 of the rotatable coupling 12 has been connected by means of a hinge or universal joint 19 to a rigid bar or post 20, the lower part of which has been coupled at 21 by means of a second universal joint to the ground anchor 22.

Along this post 20 a pipe 23 has been provided which has been connected to the coupling 12, 18 by means of the tube section 24.

The columns have been ballasted at the lower part thereof as for instance indicated at 25. With reference to FIG. 3 of the drawings, reference 1 to a buoy which corresponds with the buoy of FIGS. 1 and 2 except that in place of the rigid bar or post 20 of the buoy of FIGS. 1 and 2, the buoy of FIG. 3 is shown having high strength connecting means in the form of a chain 30.

It will be clear that other embodiments are conceivable. Thus the buoyant body present below the water level may for instance be shaped as a ring.

In the embodiment shown the columns are placed at a slight oblique angle whereby the distance to the chain 20 and the pipe 23 is the largest at the lower part. Also in this respect variations are conceivable.

I claim:

1. A single point mooring buoy including:

(a) a ground anchor;

(b) a high strength connecting means having a lower end connected to the ground anchor, and having an upper end adapted for connection to a buoy member; and (c) a buoy member adapted to have a substantial portion thereof submerged during use, the buoy member comprising a plurality of buoyancy members which are linked in spaced relationship to provide an open structure, the structure defining an upper end of the buoy member to project above water level during use, an open lower end of greater cross-section than the upper end to be submerged during use, and a hinge which is mounted at the upper end of the buoy member to be above water level during use, the hinge being positioned centrally relatively to the buoyancy members;

the upper end of the connecting means extending through an open lower end of the buoy member and being hingedly connected to the hinge, the buoyancy members being spaced about the upper end of the connecting means to avoid contact between the connecting means and the buoyancy members during relative movement of the connecting means and the buoy member about the hinge under normal conditions, and the buoyancy members being sufficiently spaced from each other to permit water movement through the buoy member between the buoyancy members during use.

2. A mooring buoy according to claim 1, in which the buoy member comprises at least three elongated tubular buoyancy members which extend at circumferentially spaced intervals about the upper end of the connecting means between the upper and lower ends of the buoy member.

3. A mooring buoy according to claim 2, in which the tubular buoyancy members are inclined to taper inwardly relative to each other towards their respective upper ends.

4. A mooring buoy according to claim 1, in which the buoy member has a hawser connection mounted at its upper end above the hinge.

5. A mooring buoy according to claim 1, in which the buoy member has a rotatable coupling mounted above the hinge, the coupling comprising an upper portion and a lower portion rotatably connected to the upper portion, and in which the buoy has a supply pipe extending along the connecting means and connected to the lower portion, and a delivery pipe extending from the upper portion.

* * * * *